US005445433A

United States Patent [19]

Avihod

[11] Patent Number: 5,445,433

[45] Date of Patent: Aug. 29, 1995

[54] KIT FOR A RECLINING CHAIR-BACK THORACIC-LUMBAR-SACRAL CORRECTIVE ORTHOSIS WHEELCHAIR

[75] Inventor: Eli Avihod, Studio City, Calif.

[73] Assignee: Medisol U.S.A. Inc., South El Monte, Calif.

[21] Appl. No.: 116,240

[22] Filed: Sep. 1, 1993

[51] Int. Cl.[6] ..... A47C 1/024

[52] U.S. Cl. ..... 297/380; 297/DIG. 4; 297/DIG. 6

[58] Field of Search ..... 297/230.12, 284.5, 354.1, 297/354.12, 380–382, DIG. 4, DIG. 6

[56] References Cited

U.S. PATENT DOCUMENTS

| | | | |
|---|---|---|---|
| 3,419,309 | 12/1968 | Smith | 297/380 X |
| 4,688,843 | 8/1987 | Hall | 297/DIG. 4 X |
| 4,824,169 | 4/1989 | Jarrell | 297/284.5 X |
| 5,035,467 | 7/1991 | Axelson et al. | 297/354.1 X |
| 5,265,292 | 11/1993 | Underell | 297/380 X |

FOREIGN PATENT DOCUMENTS

| | | | |
|---|---|---|---|
| 1198232 | 12/1985 | Canada | 297/230.12 |
| 575770 | 8/1924 | France | 297/354.12 |
| 587105 | 6/1959 | Italy | 297/380 |

*Primary Examiner*—Peter R. Brown
*Attorney, Agent, or Firm*—Drucker & Sommers

[57] ABSTRACT

A kit for converting a non-reclining wheelchair into a reclining wheelchair with a thoracic-lumbar-sacral correcting orthosis ("TLSO") corrective chair back. The TLSO chair back portion is hingeably affixed to the frame of a wheelchair which has had its non-reclining chair back removed. The desired degree of incline of the TLSO chair back portion is set by adjustment of recline adjustment straps.

14 Claims, 4 Drawing Sheets

Fig. 6a
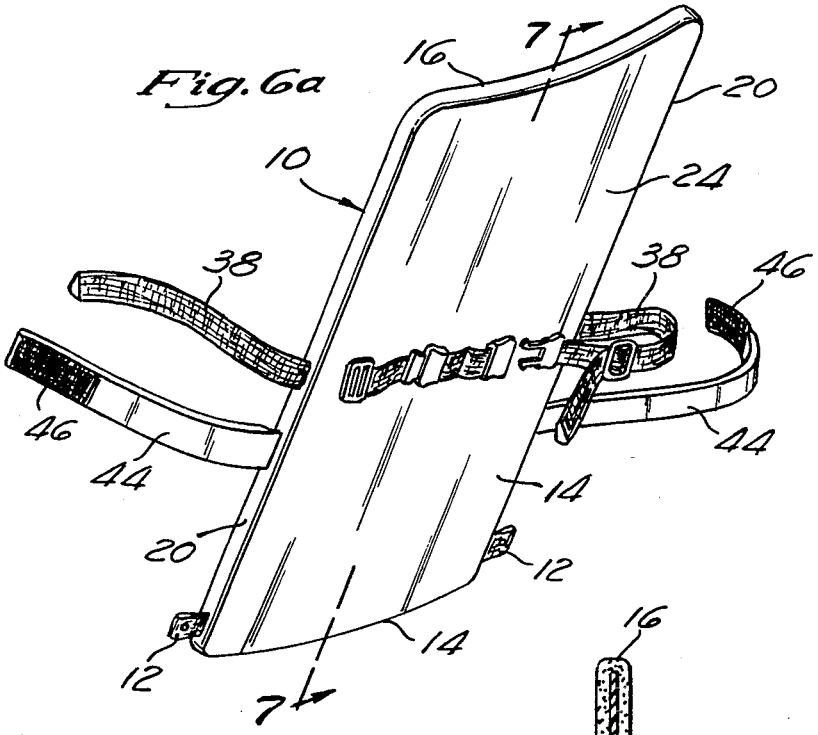
Fig. 7b
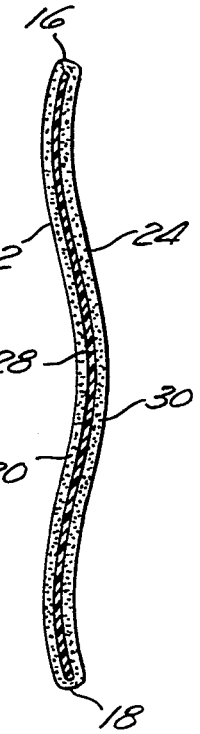
Fig. 7a
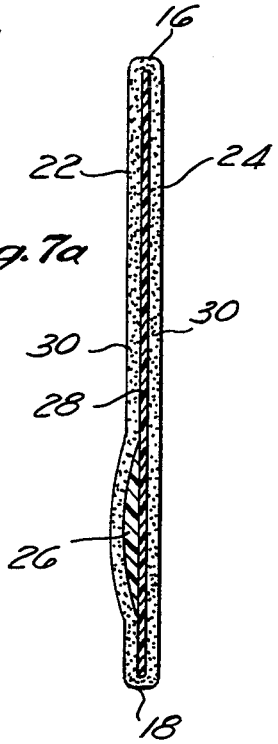
Fig. 9
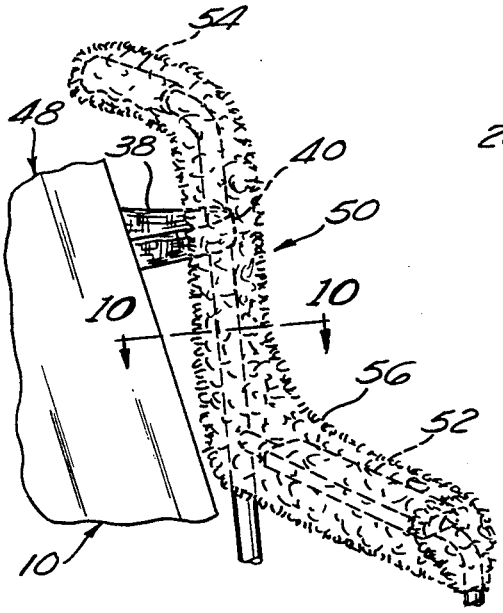
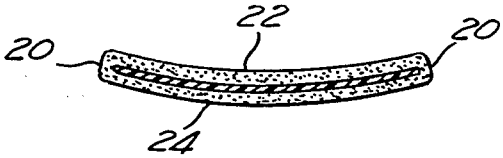
Fig. 8

KIT FOR A RECLINING CHAIR-BACK THORACIC-LUMBAR-SACRAL CORRECTIVE ORTHOSIS WHEELCHAIR

BACKGROUND OF THE INVENTION

1. Field of The Invention

The invention relates to the field of wheelchairs and more particularly to a kit which allows an unadjustable straight backed wheelchair, such as a folding wheelchair, to be converted into unadjustable back wheelchair, wherein the back of the wheelchair can be positioned along a continuum between a fully reclined position and an upright position. Thus converted, the adjustable back wheelchair can readily be used to gradually transition a bed ridden patient from the supine position, to a more upright sitting position. Preferably, the back portion of the kit is shaped to perform corrective thoracic-lumbar-sacral corrective orthosis, for controlling and correcting unhealthy postural curvature and deformities of the spine.

2. Description of the Prior Art

Various reclining back wheelchairs are available. One such chair is the BCW recliner chair, offered by Wheelchair Institute of Kansas, of 910 Main Street, LaCrosse, Kans. 67548. Unfortunately, the available reclining chairs are heavy, bulky and very costly when compared to non-reclining wheelchairs.

In contrast, however, most patients have access to or own regular folding or non-folding wheelchairs which are relatively inexpensive. Few prior art wheelchairs provide the patient with adequate back support. Most prior art wheelchairs have pliable backs which allow the patient's back to bend and arch further out of correct alignment, thus causing discomfort or pain to the patient. This problem is acute for patients seated in foldable wheelchair with flexible backs and seats, which tend to hammock. Moreover, presently available reclining back wheelchairs are not TLSO devices, and none provide the restoring support of TLSO device.

There accordingly remains a need for a kit which can be used to convert a non-reclining straight back wheelchair into a reclining wheelchair.

SUMMARY OF THE INVENTION

The invention disclosed herein solves the problems outlined above by providing a convenient and low cost kit for converting a non-reclining wheelchair into a thoracic-lumbar-sacral corrective orthosis ("TLSO") reclining chair back wheelchair.

The invention comprises a kit for converting a non-reclining wheelchair having two side frames, a seat portion, and a back support portion, into a reclining wheelchair with a thoracic-lumbar-sacral correcting orthosis ("TLSO") corrective back supporting chair back which comprises:

- a TLSO chair back portion, said TLSO chair back portion having a top edge, a bottom edge, side edges, a front surface aligned to face the patient's back, and a rear surface;
- hinge means affixable to said TLSO chair back portion in the vicinity of its lower side edges; and
- a chair back portion recline adjustment and fixation means comprising adjustable straps fixable to said TLSO chair back portion and loopable around the rear portions of the side frames of the wheelchair, wherein to convert said non-reclining wheelchair to a reclining wheelchair with a TLSO chair back, the back support portion of said non-reclining wheelchair is removed and is replaced with said TLSO chair back portion, with said hinge means being fixably attached to lower rear portions of said two side frames near the seat portion, to thereby hingeably affix the TLSO chair back portion to the wheelchair, and said adjustable straps of the chair back portion are engaged with the wheelchair and adjusted to select the desired degree of recline of the TLSO chair back portion.

The invention further provides a wheelchair with a reclining chair back portion, comprising:

- a wheelchair having side frames and a seat portion;
- a chair back portion with a top edge, a bottom edge, side edges, a front surface aligned to face a patient's back when seated in the wheelchair, and a rear surface, said chair back portion being concavely curved from its two side edges as viewed from its front surface, hinge means affixed to the chair back portion in the vicinity of its lower side edges and fixed to the side frames of the wheelchair in the vicinity of the seat portion; and
- a chair portion recline adjustment and affixation means comprising adjustable straps fixed to the chair back portion, which straps are detachably engageable with the wheelchair, wherein the desired degree of incline of the chair back portion is obtained by adjustment of said adjustable straps.

BRIEF DESCRIPTION OF THE DRAWINGS

FIG. 7*a* is a cross-sectional view of the chair back portion (of FIG. 6 through view lines 7—7, showing a first embodiment having an optional lumbar support cushion.

FIG. 7*b* is a cross-sectional view of the back support portion of FIG. 6 through view lines 7—7, showing a second embodiment formed to have a S-shaped curve.

FIG. 8 is a cross-sectional view of the back support portion of FIG. 6 through view lines 8—8.

FIG. 9 is a partial perspective view of an accessory arm rest cushion of the invention.

DETAILED DESCRIPTION OF THE DRAWINGS

Figure 1:
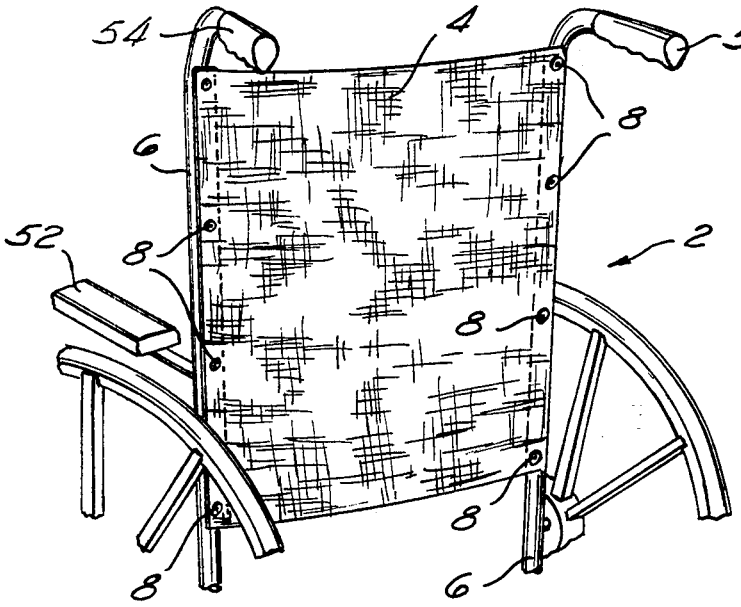
Fig. 1 (PRIOR ART)
FIG. 1 is a partial rear perspective view of a prior art non-reclining wheelchair.
Figure 3:
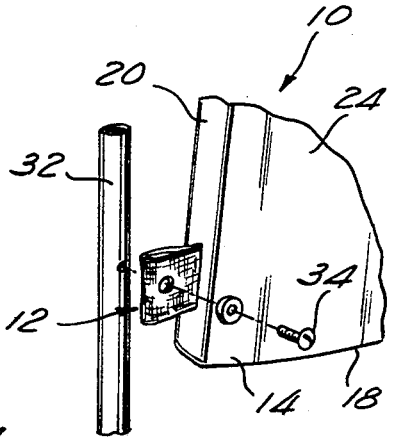
FIG. 3 is a perspective close-up view of FIG. 2, taken in the partially circled area 3—3, showing the hinged attachment of the reclining chair back portion to the frame of a wheelchair.

Referring to FIG. 1, a prior art non-reclining folding wheelchair 2 is shown, having a flexible and non-reclining seat back 4. The seat back 4 is typically affixed to the side frames 6 of the wheelchair with a series of screws 8.

Referring to FIGS. 2, 3 and 6–8, the kit of the invention comprises a rigid chair back portion 10 having hinged portions 12 located at its lower side region 14. The rigid chair back portion 10 has a top edge 16, a bottom edge 18, side edges 20, a front surface 22 aligned to face the patient's back, and a rear surface 24. As best shown in FIG. 8, chair back portion 10 is curved from its two side edges 20 concavely to generally conform with the patient's back, from its top edge 16 to its bottom edge 18. This curving accommodates the natural arch of a person's back from side to side. The curvature and rigidity is important from a comfort standpoint since a straight and flexible back portion will improperly cradle the patient's back, and will thus be incompatible with the corrective and supportive functions of the TLSO device.

In order to provide for proper TLSO orthosis, in addition to being curved from side edge 20 to side edge 20, the chair back portion 10 can be formed in the shape of an S-curve along a line between its top 16 and bottom edges 18, as best shown in FIGS. 7*b*. In lieu of, or as a complement to such top to bottom shaping, a pad or pads 26 can be placed on the front face 22 of the chair back portion 10 to custom fit the chair back portion 10 to the patient's particular TLSO requirements, as is shown in FIG. 7*a*. If the patient's back has insufficient and/or incorrect curvature, for example, in its lumbar or sacral region, a properly sized and shaped pad 26 can be selected, and positioned. Thus, a few standard sized chair back portions 10 can be made and then custom fitted to the patient's requirements by selection of the proper sized attachable pads 26.

Figure 6B:
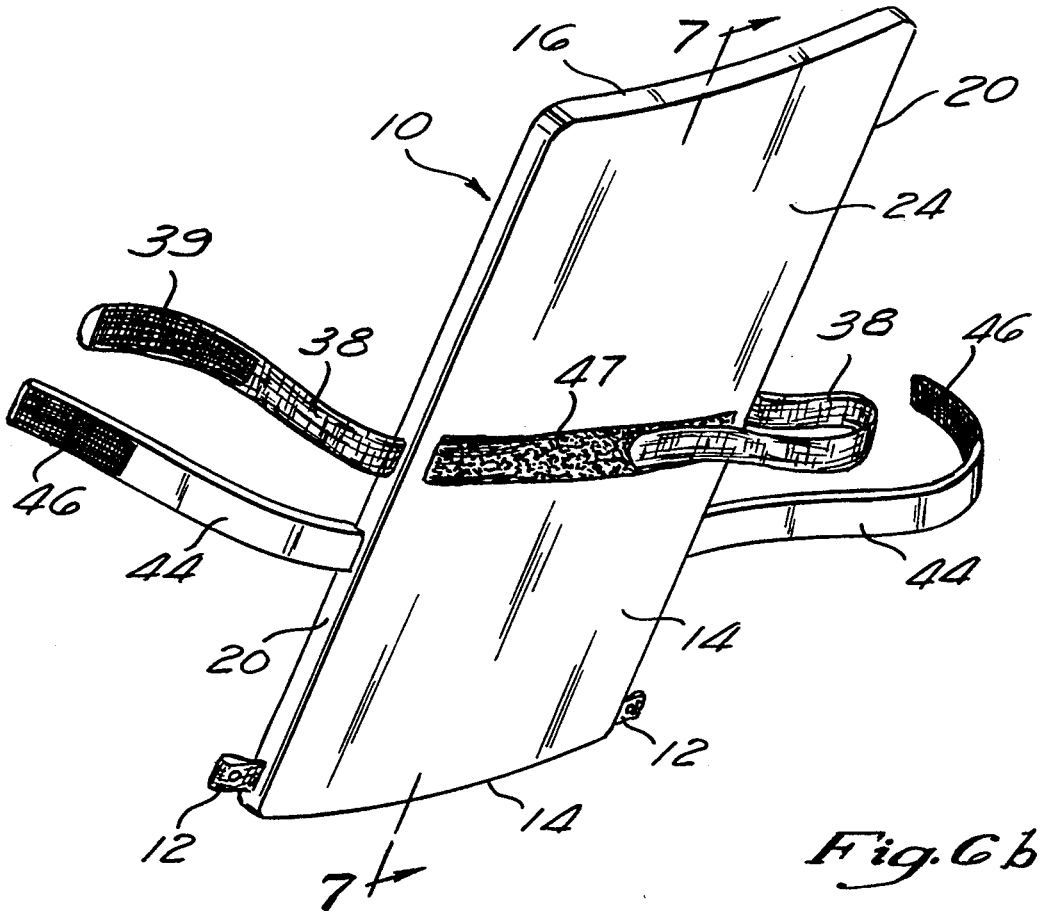
FIG. 6 is a rear view of the reclining chair back portion of the invention.

FIGS. 7*a*, 7*b* and 8 are cross-sectional views through the back support portion of FIG. 6. The core of the TLSO chair back portion 10 can be made from wood, plastic, metal or other suitable materials. The back support portion 10 can be conveniently made from a multiply wood sheet which has been heat and pressure shaped to form the arcuate core 28, or alternately from molded plastic or shaped metal. The arcuate core 28 can be, but need not be overlain with a layer of foam or padding material 30 to give it extra cushion. The proper size, shape, density of material, and position of the lumbar support cushion 26 will be selected by the physician, chiropractor, or other health care professional fitting the patient's wheelchair with the appropriate chair back portion 10. After the proper lumbar support cushion 26 is selected and its proper position is determined, it can then be secured in place against the core 28, such as by hook and loop materials or by gluing. For ease of use, and for ready access to the lumbar support cushion 26, an access means such as a zipper or laced opening can be provided (not shown). In the event the health care professional does not desire that the patient or other unauthorized person disrupt the lumbar support cushion 26, access to the lumbar support cushion 26 can be made inconvenient by sewing or otherwise permanently securing the covering completely around the arcuate core 28.

The hinging portions 12 located at the lower side region 14 provide the major (pivotal) attachment point of the chair back portion 10 to the wheelchair 2, which will now be described.

The hinging portions 12 comprise a means to allow the chair back portion 10 to pivot therefrom when affixed to side rails 32 of the wheelchair 2. One convenient and low cost hinge means available is to permanently attach a short flexible strap portion 12, such as a nylon strap 12, to the two lower side regions 14 the chair back portion 10. The short flexible strap 12 can then be attached, for example, by screws 34, to the lower back portion side rails 32 of the wheelchair 2, near the seat 36 of the wheelchair 2. These screws 34 can be screwed into the same screw holes used by the screws 8 to hold the flexible and non-reclining seat back 4 of a traditional folding wheelchair 2. Due to the flexibility and twistability of the strap portions 12, the chair back portion 10 will then be pivotally mounted to the chair 2, such that the chair back portion 10 can be reclined, or set upright, as the user desires. Other hinge means can be utilized if desired, such as a pintle hinge, with the rod portion on either of the lower chair back portion or the side frame of the wheelchair (not shown).

Figure 2:
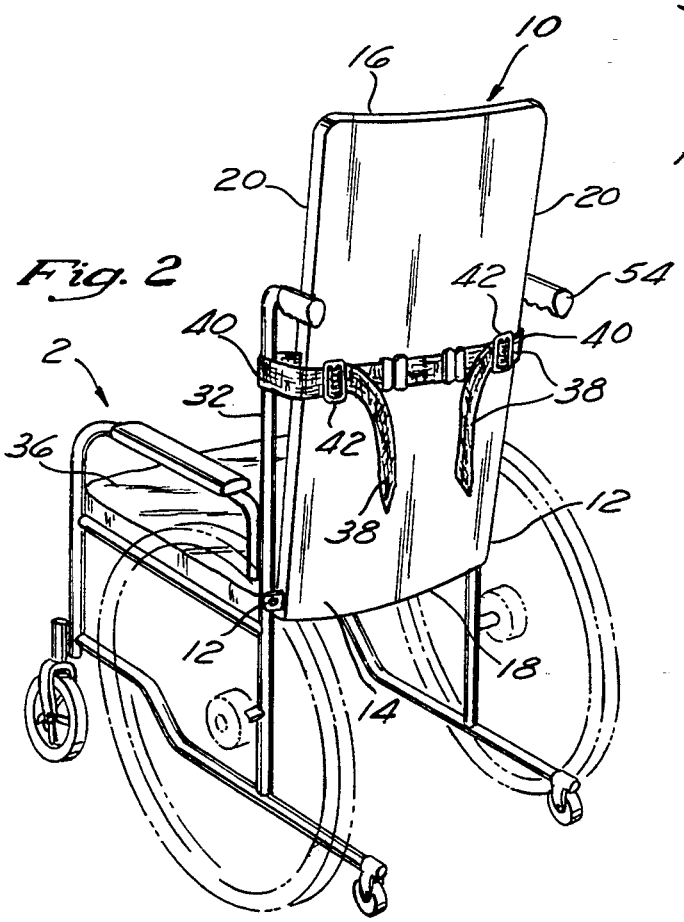
FIG. 2 is a rear perspective view of a conventional wheelchair equipped with a reclining chair back portion of the invention.
Figure 4:
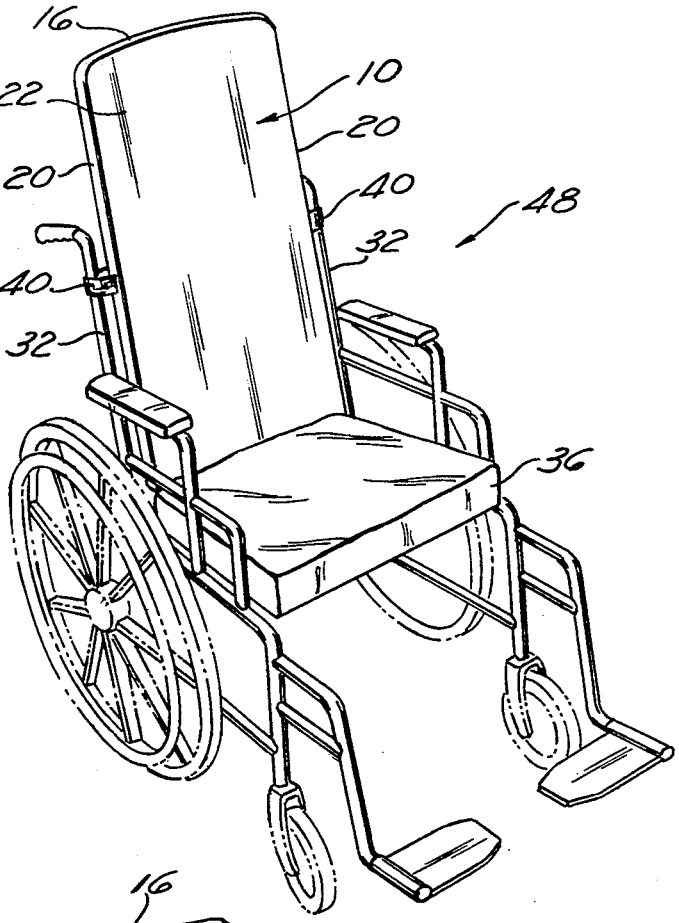
FIG. 4 is a front perspective view of the wheelchair of FIG. 2 fitted with the reclining chair back portion.
Figure 5:
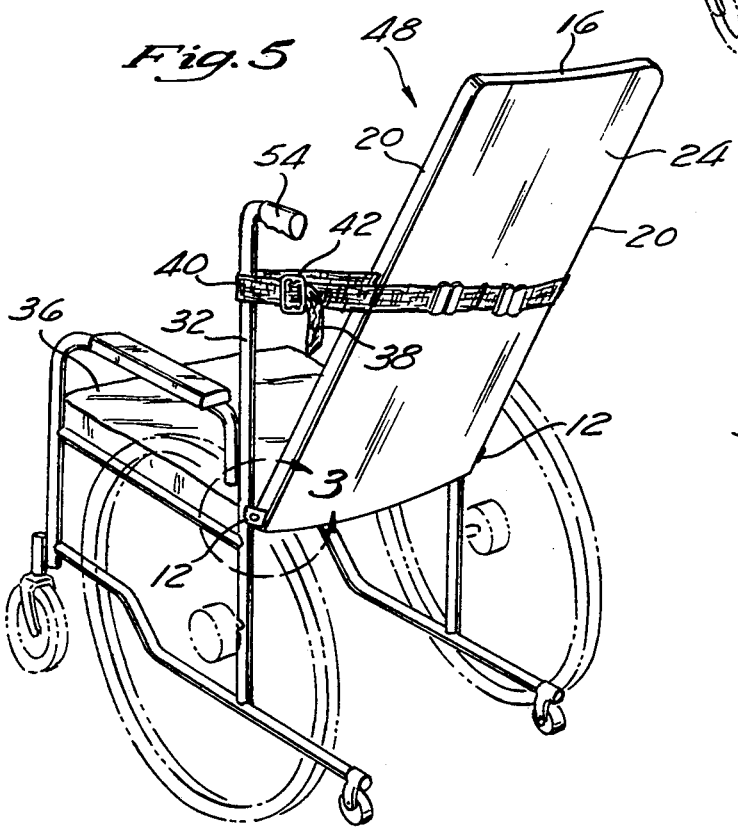
FIG. 5 is a rear perspective view of the wheelchair of the invention, with the reclining chair back portion in a partially reclined orientation.

The slant of the chair back portion 10, relative to the wheelchair is adjusted by slant adjustment means. One such means comprises straps 38 affixed to the chair back portion 10 and extending outwardly from the side edges 20 thereof. These straps 38 are looped around side rails 32 of the wheelchair's 2 frame, and detachably and adjustably affixed to the rear surface. The distance between the side edges 20 of the chair back portion 10 and the folded over loops 40 of the straps 38 can thus be adjusted, and thereby used to select the desired degree of slant at which the chair back portion 10 reclines. For example, FIG. 2 shows the relatively upright angle of the chair back portion 10 when the straps 38 are shortened up, and FIG. 5 shows the straps 38 lengthened, to allow the chair back portion 10 to recline more. In order to modify the slant of the chair back portion 10, the user need only adjust the straps 38 to quickly and easily bring the chair back portion 10 to the desired position. Snaps, buckles, adjustment rings 42, and other known detachable adjustment means can likewise be used to provide the slant adjustability of the chair back portion 10.

In order to help prevent the patient from slumping while seating in the wheelchair, the chair back portion 10 can be equipped with torso restraining straps 44. When the patient is seated in the wheelchair, these torso restraining straps 10 will be wrapped and secured around the patient's abdominal and/or chest region (not shown). Alternately, the straps 38 can have hook and loop material 39 of one kind at its ends and complementary hook and loop material 41 attached to the rear surface 24 of the TLSO chair back portion 10. The straps 38 can thus be engaged around the side frames of the wheelchair and detachably engaged with the rear surface of the TLSO chair back portion, so the TLSO chair back portion will thus be allowed to recline rearwardly by the degree desired. Substantially wide, padded straps 44 with hook and loop material 46 work well to comfortably secure the patient in the wheelchair 2.

The hinge straps 12, as well as the torso restraining straps 44 can be conveniently and permanently attached to the edges of the chair back portion 10 near its edges 20 by stitching, or can be made detachably attachable (not shown).

A wheelchair 2 fitted with the chair back portion 10 is thus converted to a reclining wheelchair 48. The reclining wheelchair 48 is also preferably fitted with an accessory seat padded cushion 36 which does not allow sagging. The seat cushion 36 can be made to be relatively stiff or soft, as the need arises. For example, for use with foldable wheelchairs, which generally have flexible vinyl seats, it is preferable that the accessory seat cushion 36 be firm, and have a relatively inflexible core.

Figure 10:
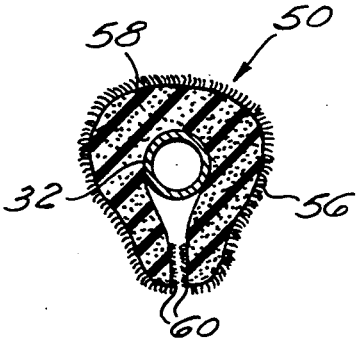
FIG. 10 is a cross-sectional view of the arm rest cushion of FIG. 9 through view lines 10—10.

Referring to FIGS. 9 and 10, in order to provide additional comfort to the wheelchair user, a novel cover 50 can be installed to cover the arm rests 52 and pushing handles 54. The padded cover 50 will greatly enhance patient comfort when he or she rests his or her arms on the arm rests 52 and/or leans to one side of the wheelchair 48. The cover 50 has an outer fabric cover 56 covering, preferably of artificial sheepskin or the like, and a foam filled core 58. To secure the cover 50 around the arm rest 52 and handles 54, releasable attachment means, such as hook and lace material 60 is sewn to inwardly facing surfaces of the cover 10.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated and although specific terms have been employed, they are intended in a generic and descriptive sense only and not for the purpose of limitation, the scope of the invention being delineated in the following claims:

I claim:

1. A kit for converting a non-reclining wheelchair having two side frames, a seat portion, and a back support portion, into a reclining wheelchair with a thoracic-lumbar-sacral correcting orthosis ("TLSO") corrective back supporting chair back, comprising:

a TLSO chair back portion, said TLSO chair back portion having a top edge, a bottom edge, side edges, a front surface aligned to face the patient's back, and a rear surface;

hinge means affixed to said TLSO chair back portion in the vicinity of its lower side edges, said hinge means providing a means to pivotably attach said TLSO chair back portion to the wheelchair; and a chair back portion recline adjustment and fixation means comprising straps fixed at one end to said TLSO chair back portion and loopable around the side frames of the wheelchair and detachably fixable at its other end to the TLSO chair back portion, at least one of said straps and said TLSO chair back portion carrying a means to adjust the working length of the straps as measured from the sides of the chair back portion to the side frames of the wheelchair, wherein in the use of the kit to convert a non-reclining wheelchair to a reclining wheelchair with said TLSO chair back portion, the back support portion of the non-reclining wheelchair is removed and is replaced with said TLSO chair back portion, by fixably attaching said hinge means to lower rear portions of the two side frames near the seat portion, to thereby hingeably affix the TLSO chair back portion to the wheelchair, and said adjustable straps of the chair back portion are looped around the side frames of the wheelchair and their working length is adjusted to select the desired degree of recline of the TLSO chair back portion.

2. The kit for converting a non-reclining wheelchair into a TLSO reclining wheelchair of claim 1, wherein the TLSO chair back portion is concavely curved from its two side edges as viewed from its front surface.

3. The kit for converting a non-reclining wheelchair into a TLSO reclining wheelchair of claim 1, wherein the TLSO chair back portion has a central rigid core which is padded, and which is concavely curved from side edge to side edge, in general conformity with a seated patient's back, and curved to follow a general "S"—curve from its top to bottom edges.

4. The kit for converting a non-reclining wheelchair into a TLSO reclining wheelchair of claim 1, wherein the TLSO chair back portion has a central rigid core which is padded, and which is concavely curved from side edge to side edge, in general conformity with a seated patient's back, and further comprising at least one properly shaped and sized cushion which is fixable to the front surface of the chair back portion, which cushion is utilized to give the chair back portion desired curvature between its top edge and bottom edge.

5. The kit for converting a non-reclining wheelchair into a TLSO reclining wheelchair of claim 1, wherein the hinge means affixed to the vicinity of the lower side edges of the chair back portion comprise flexible straps, which straps are affixed to lower rear portion of the side frames by attachment means.

6. The kit for converting a non-reclining wheelchair into a TLSO reclining wheelchair of claim 1, wherein the straps of the chair back portion recline adjustment and fixation means comprise straps which are extendable outwardly away from side edges of the TLSO chair back portion at a position above the hinge means, said straps having hook and loop material, and complementary hook and loop material attached to the rear surface of the TLSO chair back portion, wherein when the straps are engaged with the side walls of the wheelchair and detachably engaged with the rear surface of the TLSO chair back portion, the TLSO chair back portion will be thus allowed to recline rearwardly to the degree desired by the patient.

7. The kit for converting a non-reclining wheelchair into a TLSO reclining wheelchair of claim 1, further comprising torso straps which extend from the TLSO chair back portion and which can be wrapped around a patient's torso and detachably engaged together to restrain a patient seated in the converted wheelchair.

8. A wheelchair with a reclining chair back portion comprising:

a wheelchair having side frames and a seat portion;

a chair back portion with a top edge, a bottom edge, side edges, a front surface aligned to face a patient's back seated in the wheelchair, and a rear surface, said chair back portion being curved from its two side edges backwardly away from its front surface;

hinge means affixed to the chair back portion in the vicinity of its lower side edges and fixed to the side frames of the wheelchair in the vicinity of the seat portion, said hinge means allowing said chair back portion to pivot relative to the sideframes of the wheelchair; and a chair portion recline adjustment and affixation means comprising straps having working length adjustment means attached thereto, said straps being fixed at first ends to the chair back portion, which straps are detachably engageable with the wheelchair by wrapping around the side frames and by detachably attaching second ends of the straps to the chair back portion to select a desired working length of said straps, wherein to select the desired degree of incline of the chair back portion, the user will adjust the working length of the adjustable straps as measured from the sides of the chair back portion to the points on the side frames of the wheelchair around which the straps wrap.

9. The wheelchair with a reclining chair back of claim 8, wherein the chair back portion is a thoracic-lumbar-sacral corrective orthosis ("TLSO") chair back and has a central rigid core which is padded, and is curved to follow an "S"—curve from its top to bottom edges, said TLSO chair back portion thereby applying corrective TLSO orthosis to a patient who is seated in the wheelchair.

10. The wheelchair with a reclining chair back portion of claim 8, wherein the chair back portion is a thoracic-lumbar-sacral corrective orthosis ("TLSO") chair back and has a central rigid core which is padded, and further comprises at least one properly shaped and sized cushion which is fixable to the front surface of the chair back portion, which cushion is utilized to give the chair back portion desired curvature between its top edge and bottom edge.

11. The wheelchair with a reclining chair back portion of claim 8, wherein the straps of the recline adjustment and affixation means are extendable outwardly away from side edges of the TLSO chair back portion at a position above the hinge means, said straps having hook and loop material attached thereto, the recline adjustment and affixation means further comprising complementary hook and loop material attached to the rear surface of the TLSO chair back portion, wherein when the straps are engaged with the rear surface of the TLSO chair back portion, the TLSO chair back portion will be thus allowed to recline rearwardly to the degree desired by the patient.

12. The wheelchair with a reclining chair back portion of claim 8, further comprising torso straps which extend from the chair back portion and which can be wrapped around a patient's torso and detachably engaged together to restrain a patient seated in the wheelchair of the invention.

13. A kit for converting a non-reclining wheelchair having two side frames, a seat portion, and a back support portion, into a reclining wheelchair with a thoracic-lumbar-sacral correcting orthosis ("TLSO") corrective back supporting chair back, comprising:

a TLSO chair back portion, said TLSO chair back portion having a top edge, a bottom edge, side edges, a front surface aligned to face the patient's back, and a rear surface;

hinge means comprising flexible hinging straps which are fixed at first ends to said TLSO chair back portion in the vicinity of its lower side edges, and which are affixable at second ends to lower rear portions of the side frames by attachment means; and a chair back portion recline adjustment and fixation means comprising straps fixed at one end to said TLSO chair back portion and loopable around the side frames of the wheelchair and detachably fixable at other ends to the TLSO chair back portion with means to adjust the working length of the straps as measured from the sides of the chair back portion to the side frames of the wheelchair, said means to adjust the working length being located on at least one of the straps and chair back portion, whereby in the use of the kit to convert the non-reclining wheelchair to a reclining wheelchair with a TLSO chair back, the back support portion, only, of the non-reclining wheelchair is removed and is replaced with said TLSO chair back portion, with said hinge means being fixably attached to lower rear portions of the two side frames near the seat portion, to thereby hingeably affix the TLSO chair back portion to the wheelchair, and said adjustable straps of the chair back portion are engaged with the wheelchair and their working length is adjusted to select the desired degree of recline of the TLSO chair back portion.

14. A method to convert a non-reclining wheelchair having a two-sided frame, a sling seat portion and a sling back portion, into a reclining wheelchair with a thoracic-lumbar-sacral correcting orthosis ("TLSO") corrective back supporting chair back, comprising:

removing the sling back portion of the wheelchair;

providing a TLSO chair back portion having a top edge, a bottom edge, side edges, a front face aligned to face a patient's back, and a rear surface, a pair of hinging straps fixed to the chair back portion near its bottom edge and extending from the side edges, a chair back recline adjustment and fixation mean comprising looping straps fixed to the chair back portion above the hinging straps with means to adjust the length of the looping straps carried on at least one of said straps and said TLSO chair back portion; and attaching the chair back portion to the wheelchair by affixing the hinging straps to the side frame of the wheelchair, and looping the looping straps around the side frames and adjusting their length to adjust the degree of recline of the chair back portion; and attaching the looping straps to the rear surface of the TLSO chair back

* * * * *